US011411350B2

(12) United States Patent
Martinez et al.

(10) Patent No.: US 11,411,350 B2
(45) Date of Patent: Aug. 9, 2022

(54) ELECTRICAL CONNECTOR APPARATUS AND METHODS OF MANUFACTURING THE SAME

(71) Applicant: PGS Geophysical AS, Oslo (NO)

(72) Inventors: Ramon Martinez, Houston, TX (US); Nick C. George, Richmond, TX (US); Martin Hunley, Plano, TX (US); Melissa Lugo Brito, Fulshear, TX (US)

(73) Assignee: PGS GEOPHYSICAL AS, Olso (NO)

( * ) Notice: Subject to any disclaimer, the term of this patent is extended or adjusted under 35 U.S.C. 154(b) by 205 days.

(21) Appl. No.: 16/891,692

(22) Filed: Jun. 3, 2020

(65) Prior Publication Data

US 2020/0395715 A1 Dec. 17, 2020

Related U.S. Application Data

(60) Provisional application No. 62/860,427, filed on Jun. 12, 2019.

(51) Int. Cl.

| | |
|---|---|
| ***H01R 13/6463*** | (2011.01) |
| ***H01B 7/14*** | (2006.01) |
| ***H01B 7/282*** | (2006.01) |
| ***H01R 13/516*** | (2006.01) |
| ***H01R 13/52*** | (2006.01) |
| ***H01R 13/42*** | (2006.01) |
| ***H01B 11/02*** | (2006.01) |

(52) U.S. Cl.

CPC ..... *H01R 13/6463* (2013.01); *H01B 7/14* (2013.01); *H01B 7/282* (2013.01); *H01B 11/02* (2013.01); *H01R 13/42* (2013.01); *H01R 13/516* (2013.01); *H01R 13/52* (2013.01); *H01R 13/521* (2013.01)

(58) Field of Classification Search

CPC .. H01R 13/6463; H01R 13/42; H01R 13/516; H01R 13/52; H01R 24/86; H01R 2107/00; H01R 13/521; H01R 13/5219; H01R 33/965; H01R 24/28; H01R 13/514; H01B 7/14; H01B 7/282; H01B 11/02

See application file for complete search history.

(56) References Cited

U.S. PATENT DOCUMENTS 3,772,637 A * 11/1973 Paullus ..... B25B 7/00 174/76
5,510,577 A 4/1996 Corrigan
6,319,073 B1 * 11/2001 Menolotto ..... H01R 13/523 439/744
6,716,063 B1 * 4/2004 Bryant ..... H01R 13/5208 439/589

(Continued)

FOREIGN PATENT DOCUMENTS

JP 2001155564 A * 6/2001

*Primary Examiner* — Travis S Chambers

(57) ABSTRACT

A class of electrical connectors are described along with methods of manufacturing the same. In one example embodiment, a method of assembling a connector includes extending a twisted pair through a slot in a seal plate; untwisting the twisted pair along a first distance; inserting first and second conductors of the twisted pair through first and second through holes of a seal carrier; coupling first and second electrical terminals to the first and second conductors; re-twisting the twisted pair along a portion of the first distance by rotating the seal carrier; and inserting the seal carrier into the slot of the seal plate.

20 Claims, 8 Drawing Sheets

(56) References Cited

U.S. PATENT DOCUMENTS

| | | | | |
|---|---|---|---|---|
| 9,117,566 | B2 | 8/2015 | McCleary et al. | |
| 9,502,158 | B2 | 11/2016 | Bes et al. | |
| 2008/0230232 | A1 | 9/2008 | Farrara | |
| 2014/0308846 | A1* | 10/2014 | Bianca | H01R 13/41 439/595 |
| 2015/0325336 | A1 | 11/2015 | Maples | |

* cited by examiner

ELECTRICAL CONNECTOR APPARATUS AND METHODS OF MANUFACTURING THE SAME

CROSS-REFERENCE TO RELATED APPLICATIONS

This application claims the benefit of U.S. Provisional Application Ser. No. 62/860,427 filed Jun. 12, 2019 titled "Connector Sealing Techniques," which application is hereby incorporated by reference as if fully set forth herein.

BACKGROUND

Data communication takes place along many different types of communication channels. One such communication channel is a twisted pair cable. A twisted pair cable has two insulated conductors each having a length, and the two insulated conductors are twisted or wrapped around each other along their lengths. The twisting reduces cross-talk between the conductors, improving signal-to-noise ratio of the communications along the channel.

In order to connect each conductor of a twisted pair cable to downstream or upstream wires, the twisted pair conductors are un-twisted to enable coupling of electrical terminals. If the twist of the twisted pair cannot be restored, the untwisted area creates cross-talk and back reflection, which degrades signal-to-noise ratio.

BRIEF DESCRIPTION OF THE DRAWINGS

For a detailed description of example embodiments, reference will now be made to the accompanying drawings in which.

DEFINITIONS

Figure 1:
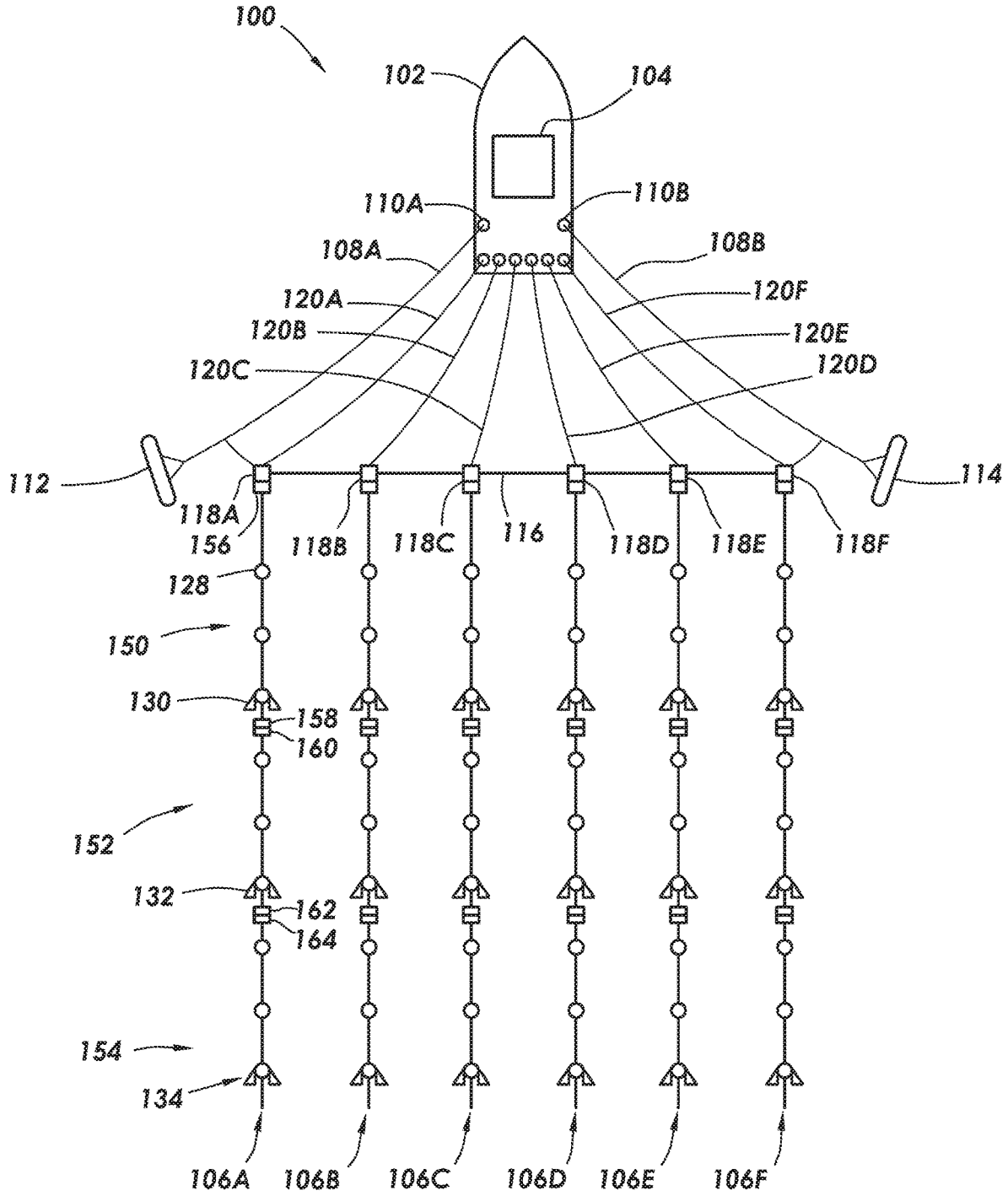
FIG. 1 shows an overhead view of a marine survey system in accordance with at least some embodiments.

Various terms are used to refer to particular system components. Different companies may refer to a component by different names—this document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

"Through bore" shall mean an aperture or hole that extends all the way through an object. However, "through bore" shall not be read to require any particular method of creation; rather, the through bore may be created in any suitable way (e.g., drilling, boring, milling, casting, laser cutting, or extruding with the through bore in place).

"Counter bore" shall mean an aperture or hole that extends only partially through an object. "Counter bore" shall not be read to require any particular method of creation; rather, the counter bore may be created in any suitable way (e.g., drilling, boring, milling, casting, or laser cutting).

"Twisted pair" shall mean a cable comprising two conductors twisted about each other and having insulation between them suitable to their purpose. The fact that a portion of a twisted pair cable may be un-twisted for a short distance (e.g., for purposes of assembly of a connector) shall not negate the status of the un-twisted portion as being a part of the twisted pair cable.

"About" in reference to a recited value shall mean the recited value +/−10% of the recited value.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Various example embodiments are directed to methods and systems of electrical connector sealing. In particular, various example embodiments are directed to methods and related systems of coupling electrical terminals to conductors of a twisted pair, and placing the conductors into a water resistant connector, while enabling the twisted pair to be re-twisted after coupling of the electrical terminals. More particularly still, example embodiments are directed to use of a seal carrier that plugs into a seal plate. The conductors extend through the seal carrier, and electrical terminals are coupled to the conductors. Thereafter, the conductors can be re-twisted and the seal carrier placed in the seal plate. The seal plate is then placed against an insert body, and the water resistant seal is made between the insert body, the seal carrier, and the conductors. The various embodiments were developed in the context of marine geophysical surveying, and will be described in that context, but the developmental context shall not be construed as a limitation. The specification now describes a marine survey system to orient the reader.

FIG. 1 shows an overhead view of a marine survey system 100 in accordance with at least some embodiments. In particular, FIG. 1 shows a tow or survey vessel 102 having onboard equipment, herein collectively referred to as recording system 104, such as navigation, energy source control, and a data acquisition system. Survey vessel 102 is configured to tow one or more geophysical sensor streamers 106A-F through the water. While FIG. 1 illustratively shows six sensor streamers, any number of sensor streamers may be used.

The sensor streamers 106A-F are each coupled, at the ends nearest the survey vessel 102 (i.e., the "proximal" or "forward" ends) to a respective lead-in cable termination 118A-F. The lead-in cable terminations 118A-F are coupled to or associated with spreader lines 116 so as to control the lateral positions of the sensor streamers 106A-F with respect to each other and with respect to the survey vessel 102. Electrical connections between the appropriate components in the recording system 104 and the sensors in the sensor streamers 106A-F (e.g., sensor 128 in sensor streamer 106A) may be made using inner lead-in cables 120A-F, respectively.

In order to control depth of the sensor streamers, and in some cases to control lateral spacing between the sensor streamers, the sensor streamers may be associated with a plurality of streamer positioning devices periodically spaced along the sensor streamers. Again referring to sensor streamer 106A as representative, a positioning device 130 may be coupled near the proximal end of sensor streamer 106A. In some cases, the positioning device 130 may provide only depth control, as the lateral spacing of the geophysical sensor streamer near the proximal end may be adequately controlled by the spreader lines 116. Further, the representative sensor streamer 106A may be associated with positioning devices 132 and 134, shown coupled further from the proximal ends. The positioning devices 132 and 134 may provide not only depth control, but also lateral positional control. While FIG. 1 shows only three positioning devices 130, 132, and 134 associated with representative sensor streamer 106A, in practice each sensor streamer may be from a few thousand meters to 10 kilometers or more in length, and have positioning devices periodically spaced along the entire length the sensor streamer (e.g., every 20-30 meters).

Each sensor streamer 106A-F may comprise a plurality of sensor streamer sections coupled end-to-end to create the overall sensor streamer 106A-F. For example, and again referring to sensor streamer 106A as representative, the sensor streamer 106A may comprise a plurality of sensor streamer sections 150, 152, and 154. While only three sensor steamer sections are shown so as not to unduly complicate the figure, in practice each sensor streamer may be a few thousand meters to 10 kilometers or more in length, and each sensor streamer section (e.g., 150, 152, and 154) may be about 75 to 100 meters in length. Thus, an overall sensor streamer may be made up of one hundred or more individual sensor streamer sections.

Still referring to sensor streamer 106A as representative, the proximal-most sensor streamer section 150 comprises a streamer connector 156 that couples to the lead-in cable 120A and spreader lines 116. Opposite the streamer connector 156, sensor streamer section 150 comprises a streamer connector 158. Sensor streamer section 152 comprises a streamer connector 160 at the proximal end that couples to streamer connector 158 of sensor streamer section 150, and sensor streamer section 152 comprises a streamer connector 162 at a distal end of the sensor streamer section 152. Sensor streamer section 154 comprises a streamer connector 164 at the proximal end that couples to the streamer connector 162 of sensor streamer section 152, and sensor streamer section 154 comprises a connector (not specifically shown) at a distal end of the second streamer section 154, and so on. Thus, the representative sensor streamer 106A is constructed from a plurality of individual sensor streamer sections (e.g., 150, 152, and 154), each of which may be about 75 to 100 meters in length.

The marine survey system of FIG. 1 is a towed system; however, in other cases the sensor streamer sections may be coupled together as discussed with respect to the sensor streamers, but used as ocean-bottom cables that remain stationary during the geophysical survey. In cases where the sensor cables are stationary, the seismic source may be towed by the tow vessel above the geophysical sensor cables. The discussion below is thus equally applicable to towed systems as well as ocean-bottom geophysical sensor cables. The discussion now turns to an example sensor cable section.

Figure 2:
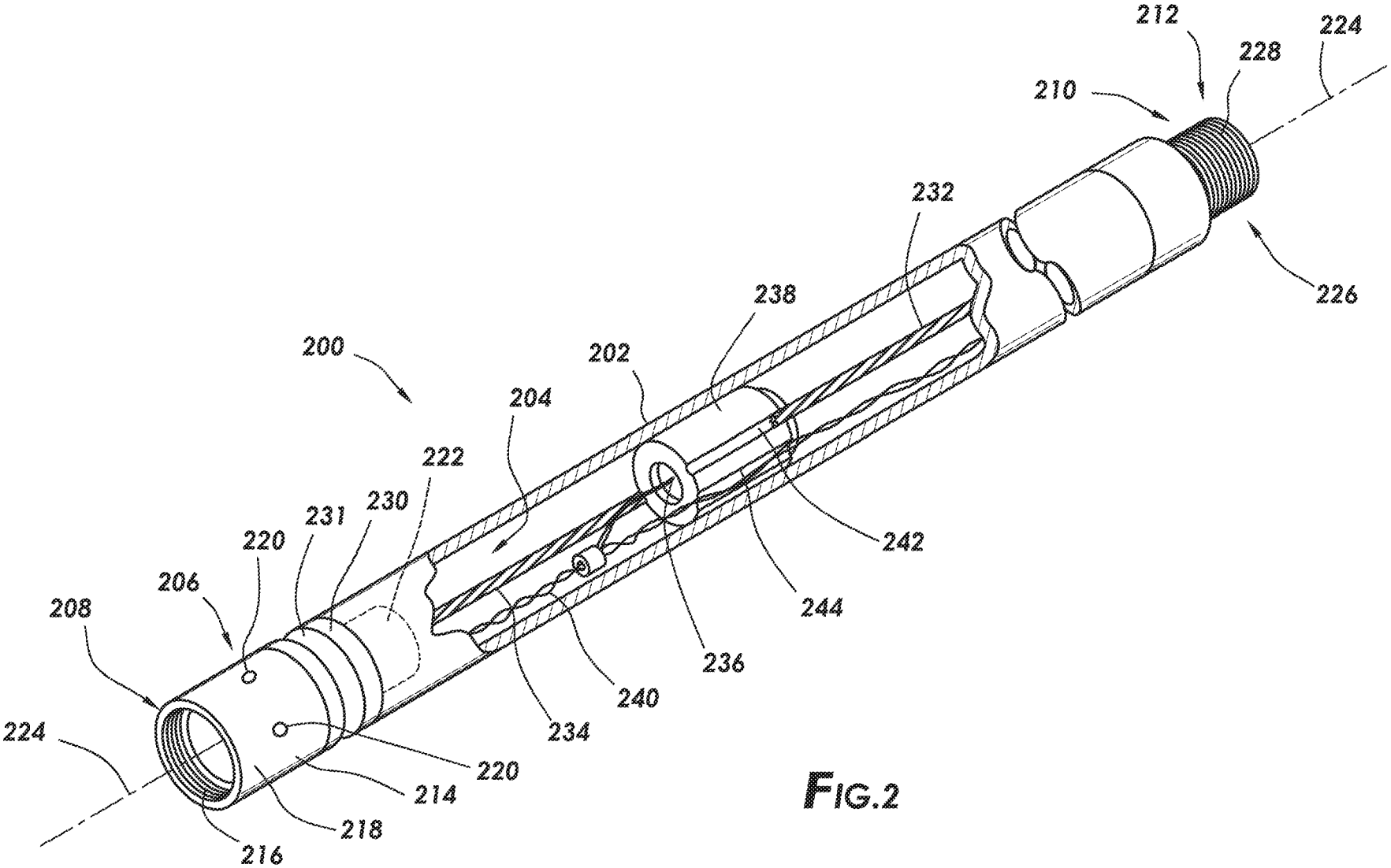
FIG. 2 shows a perspective, partial cut away, view of a sensor streamer section in accordance with example embodiments.

FIG. 2 shows a perspective, partial cut away, view of a sensor streamer section 200 in accordance with example embodiments. In particular, example sensor streamer section 200 comprises an outer jacket 202 that defines an interior volume 204, a streamer connector 206 on the proximal end 208, and a streamer connector 210 on the distal end 212. Streamer connector 206 is a socket-type connector, and thus defines a coupling ring 214 with internal threads 216, and the coupling ring 214 further defines an outside surface 218 having a plurality of blind bores 220 therein.

The streamer connector 206 further comprises a housing portion 230 coupled to the coupling ring 214. The housing portion 230 has an outside diameter about equal to the outside diameter of the outer jacket 202. The housing portion 230 further comprises an annular groove 231 which circumscribes the housing portion 230, and which annular groove 231 may be used when coupling the streamer connector 206 to the connector of the adjacent sensor streamer section. The streamer connector 206 further comprises a reduced diameter portion 222 (sometimes referred to as a "potting cup"). The proximal end of the outer jacket 202 extends over and seals against the reduced diameter portion 222. The coupling ring 214 is coupled to the remaining portions of the streamer connector 206 (e.g., the housing portion 230 and reduced diameter portion 222) in such a way that the coupling ring 214 can rotate about the central axis 224 of the coupling ring 214 while the remaining portions of the streamer connector 206 are stationary.

Streamer connector 210 is disposed at the distal end 212 opposite the streamer connector 206. The streamer connector 210 defines a plug portion 226 with external threads 228. While the example sensor streamer section 200 is shown with a socket-type streamer connector 206 on a proximal end and a plug-type streamer connector 210 on the distal end, the locations may be swapped in other embodiments. Or, if desired, the same type of connector may be used on either end of a streamer section and configured to mate with corresponding opposite gender connectors on adjacent streamer sections. The plug portion 226 has an outside diameter and thread pitch designed and constructed to threadingly couple to a coupling ring of a connector of the next distal sensor streamer section (not shown). It follows that the coupling ring 214 of streamer connector 206 on the proximal end has an inside diameter and thread pitch designed and constructed to threadingly couple to the plug-type connector of the next proximal sensor streamer section (not shown). The streamer connector 210 also defines a reduced diameter portion over which the distal end 212 of the outer jacket 202 telescopes and against which the outer jacket 202 seals, but the reduced diameter portion of streamer connector 210 is not shown so as not to unduly complicate the figure.

In the example sensor streamer section 200, tension associated with towing forces (or forces associated with deploying and retrieving the cable in an ocean-bottom context) are carried by strength members in the form of ropes coupled between the streamer connectors such that the outer jacket 202 carries little (if any) of the towing force, and in some cases the outer jacket 202 may be under slight compression. The ropes are disposed within the interior volume 204 of the outer jacket 202. The example sensor streamer section 200 comprises two such ropes 232 and 234, both of which run the length the sensor streamer section 200 and mechanically couple to the streamer connectors 206 and 210. In order not to obscure other aspects of the sensor streamer section, portions of the ropes 232 and 234 are removed from the drawing of FIG. 2. While FIG. 2 shows two ropes 232 and 234, one or more ropes may be used.

Still referring to FIG. 2, the sensor streamer section 200 further comprises a plurality of sensors (e.g., hydrophones, geophones, MEMs sensors, and/or electromagnetic sensors) spaced along the sensor streamer section 200 within the outer jacket 202. The example sensor streamer section 200 of FIG. 2 shows one sensor 236 disposed within sensor holder 238, but in practice each sensor streamer section 200 may have one hundred or more sensors depending on the type of sensors, spacing of the sensors, and the length of the sensor streamer section 200. The example sensor 236 is disposed within a sensor holder 238 that holds the sensor 236 at a particular location within the interior volume 204 along the length of the sensor streamer section 200. As shown, the example sensor holder 238 holds the sensor 236 centered in the interior volume 204. Holding the sensor 236 centered in the interior volume 204 is not required, and other off-center placements, as well as holding the sensor 236 in a gimballed arrangement, are also contemplated. The example sensor holder 238 defines an exterior surface that is largely cylindrical and abuts at least some of the inside diameter of the outer jacket 202. However, in order to accommodate the various strength members, and twisted pairs 240 (discussed more below), the sensor holder 238 comprises various apertures that may include channels accessible through the exterior surface. For example, aperture or channel 242 provides space for the rope 232 (removed from the drawing at the location of the sensor holder 238 so as not to obscure other components) to extend past the sensor holder 238. A similar aperture or channel (not specifically numbered) exists on the opposite side of the sensor holder 238 for rope 234. Finally, the example sensor holder 238 may comprise a channel 244 through which the twisted pair 240 may extend. The specification now turns to example streamer connectors in greater detail.

Figure 3:
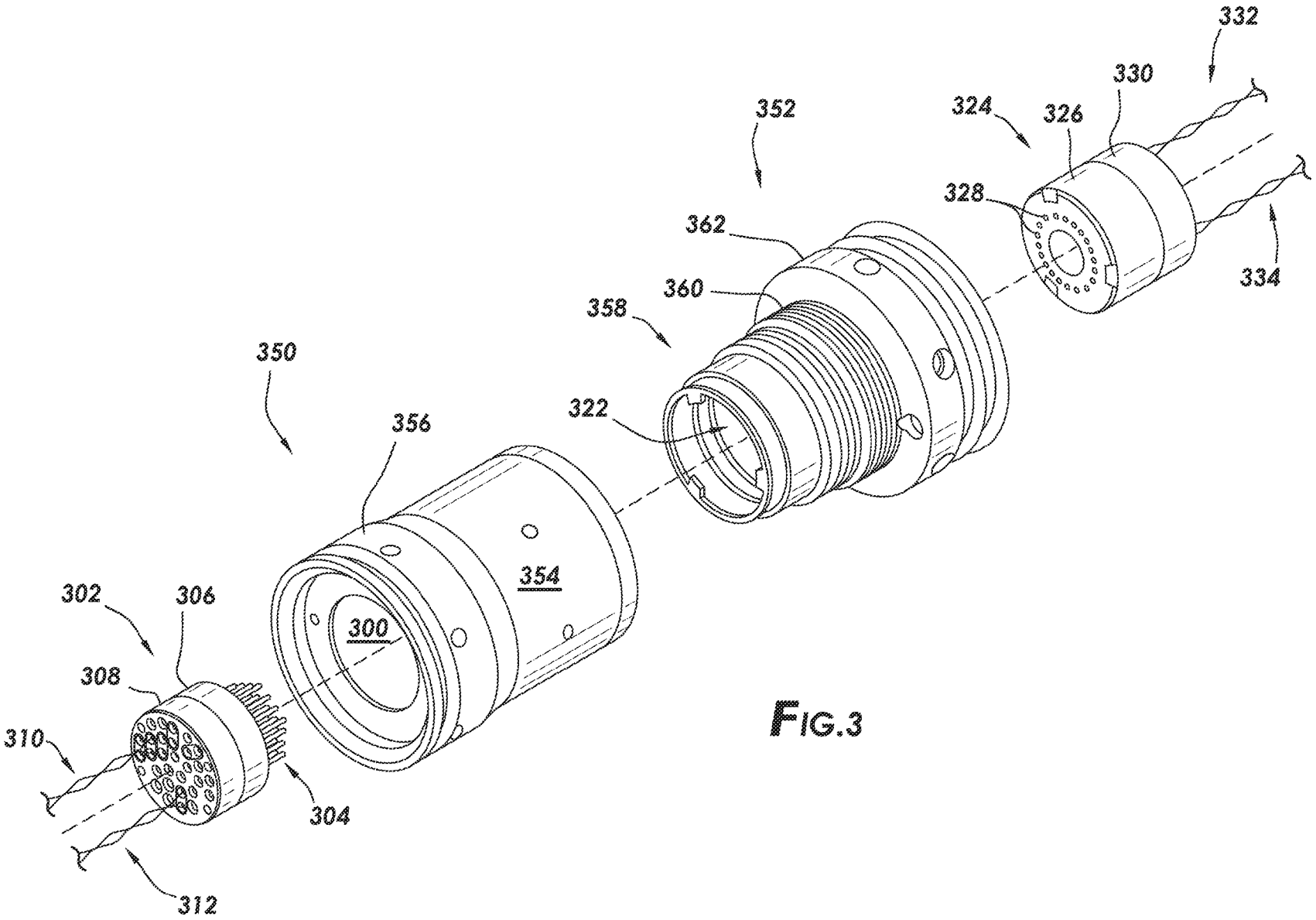
FIG. 3 shows a partial view of a socket-type streamer connector and a plug-type streamer connector, in exploded form, and in accordance with example embodiments.

FIG. 3 shows a partial view of a socket-type streamer connector 350 and a plug-type streamer connector 352, in exploded form, and in accordance with example embodiments. So as not to obscure the underlying components, FIG. 3 omits the outer jacket, the reduced diameter portions (e.g., reduced diameter portion 222 of FIG. 2) to which the outer jackets couple, and also omits the structure to which the ropes mechanically couple to each connector. In particular, FIG. 3 shows the socket-type streamer connector 350 comprising a coupling ring 354 and a housing portion 356. The housing portion 356 defines an internal aperture 300 into which a plug assembly 302 is inserted. In the example case of FIG. 3, the plug assembly 302 comprises a plurality of electrical terminals 304 which, in the illustrated example, take the form of plug-type electrical terminals. The electrical terminals 304 extend through the internal aperture 300 and are designed and constructed to mechanically and electrically couple to complementary socket-type terminals of a mating plug-type streamer connector 352. The electrical terminals 304 extend into and through an insert body 306. Thus, the electrical terminals 304 are mechanically and electrically exposed on the mating side of the insert body 306. Abutting the insert body 306 is a seal plate 308. As will be discussed in greater detail below, the seal plate 308 abuts the insert body 306 and forms a water tight or water resistant seal with the insert body 306 at the location of each electrical conductor.

In the example case of FIG. 3, two twisted pairs 310 and 312 are associated with plug assembly 302. In particular, each conductor of the twisted pair 310 is coupled to a respective electrical terminal 304, and each conductor of the twisted pair 312 is coupled to a respective electrical terminal 304. Thus, when assembled and connected, the twisted pairs 310 and 312 electrically couple to respective electrical conductors, such as twisted pairs 332 and 334 in the adjacent sensor streamer section. Additional twisted pairs may be present, as well as other electrical and communicative conductors (e.g., optical conductors, ground conductors), but such additional twisted pairs and conductors are not shown so as not to unduly complicate the figure.

FIG. 3 also shows the plug-type streamer connector 352 comprising a plug portion 358 with external threads 360, and a housing portion 362. The plug portion 358 and housing portion 362 define an internal aperture 322 into which a plug assembly 324 is inserted. In the example case of FIG. 3, the plug assembly 324 comprises a plurality of socket-type electrical terminals that extend into an insert body 326. The socket-type electrical terminals are mechanically and electrically exposed by way of apertures 328 through the insert body 326, and thus the socket-type electrical terminals are not visible in FIG. 3. The example insert body 326 extends into and abuts the distal end of the plug portion 358, and the electrical terminals are designed and constructed to mechanically and electrically couple to the plug-type electrical terminals 304 of the mating socket-type streamer connector 350. The insert body 326 abuts a seal plate 330. As will be discussed in greater detail below, the seal plate 330 abuts the insert body 326 and forms a water tight or water resistant seal with the insert body 326 at the location of each electrical conductor. In the example case of FIG. 3, two twisted pairs 332 and 334 are associated with the plug assembly 324. In particular, each conductor of the twisted pair 332 is coupled to a respective socket-type electrical terminal, and each conductor of twisted pair 334 is coupled to a respective socket-type electrical terminal. Thus, when assembled and connected, the twisted pairs 332 and 334 electrically couple to respective electrical conductors in the adjacent streamer section, such as twisted pairs 310 and 312. However, additional twisted pairs may be present, as well as other electrical and communicative conductors (e.g., optical conductors, ground conductors), but such additional twisted pairs and conductors are not shown so as not to unduly complicate the figure.

Each plug assembly 302 and 324 is associated with electrical terminals. In the example case of plug assembly 302, the electrical terminals 304 are plug-type terminals, and thus the insert body 306 is a plug-type insert body that enables the plug-type electrical terminals 304 to extend through the insert body 306 and protrude on a mating side of the insert body 306. By contrast, in the example case of plug assembly 324, the electrical terminals are socket-type terminals, and thus the insert body 326 is a socket-type insert body that enables the socket-type electrical terminals to extend into the insert body 326, and each socket-type electrical terminal is associated with a respective aperture 328. Thus, while the socket-type electrical terminals do not protrude through the insert body 326, the socket-type electrical terminals are accessibly by mating plug-type electrical terminals.

Figure 4A:
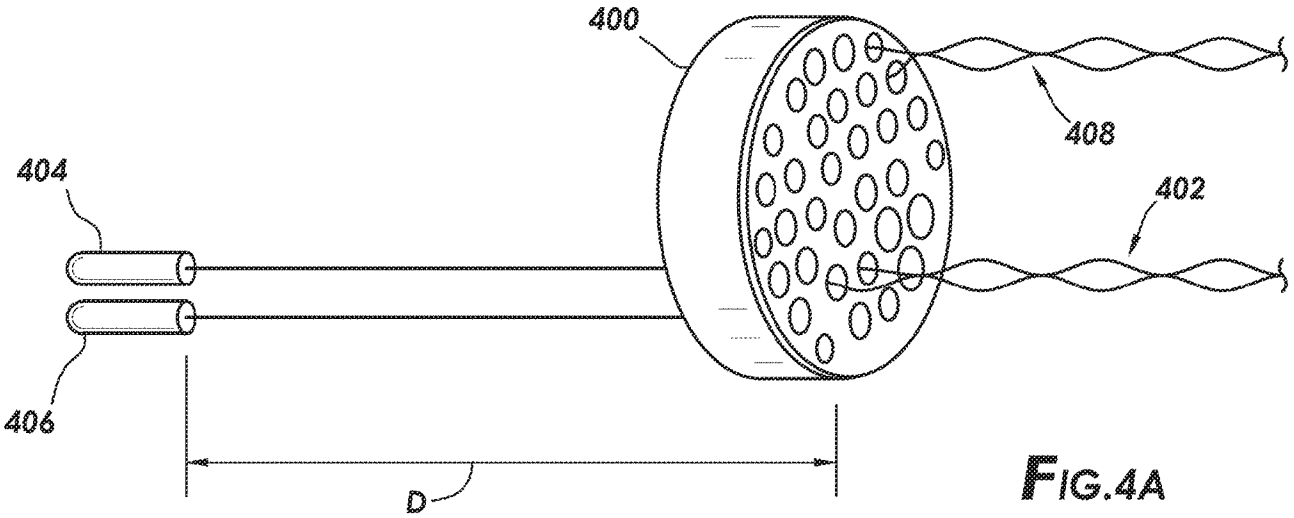
FIG. 4A shows a perspective view of a seal plate during installation of electrical terminals to a twisted pair.

The specification now turns to a discussion of some of the shortcomings of related-art devices. FIG. 4A shows a perspective view of a conventional seal plate during coupling of electrical terminals to a twisted pair. In particular, FIG. 4A shows a conventional seal plate 400 having a plurality of apertures extending through the seal plate 400. Also visible in FIG. 4A is an example twisted pair 408, a twisted pair 402, and two electrical terminals 404 and 406 associated with twisted pair 402. In conventional devices of this kind, in order to couple the electrical terminals 404 and 406 to their respective conductors, the twisted pair 402 is un-twisted for a distance D. The distance D is selected to be sufficient for a technician to couple the electrical terminals 404 and 406 to their respective conductors of the twisted pair 402. In particular, the distance D is selected to enable the technician to strip the insulation from the conductor, and to mechanically and electrically couple (e.g., crimp or solder) the electrical terminal to the conductor. In many cases, the technician un-twists the twisted pair 402 such that the distance D is about 15 centimeters.

Figure 4B:
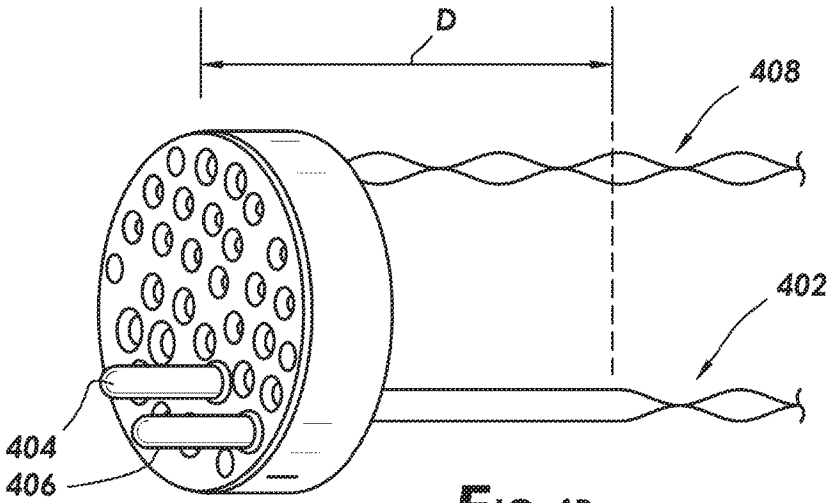
FIG. 4B shows a perspective view of a seal plate during installation of electrical terminals to a twisted pair.

Once the electrical terminals 404 and 406 are coupled to their respective conductors, the length of the un-twisted conductors is pulled back through the seal plate 400 so that the electrical terminals are close to or abut the seal plate 400. For example, FIG. 4B shows the conventional seal plate 400 with the un-twisted length of the conductors of the twisted pair 402 pulled back through the seal plate 400 so that the electrical terminals 404 and 406 are close to or abut the seal plate 400. In these kinds of conventional devices, the distance D of un-twisted conductors cannot be re-twisted to restore the original twist relationship. This is true for at least two reasons. First, the longer still-twisted length of the twisted pair cable cannot itself be rotated to achieve a re-twist along length D because the cable itself is already housed within an outer jacket or is connected to a similar assembly at its other end, or both. Second, attempting to rotate seal plate 400 to achieve a re-twist along length D would only cause twisted pairs 402 and 408 to become twisted around one another and would not achieve a re-twist along length D in either one of the pairs 402, 408 individually.

Thus, in conventional devices, each twisted pair has an untwisted distance D of conductors associated with each seal plate 400. If one considers that an equal distance was untwisted in the mating connector, the communication channel represented by twisted pair 402 and its counterpart on the other side of the connector may have an untwisted length being twice the distance D (e.g., on the order of 30 cm). The untwisted length causes signal reflections and cross-talk, which reduces signal-to-noise ratio.

Figure 5:
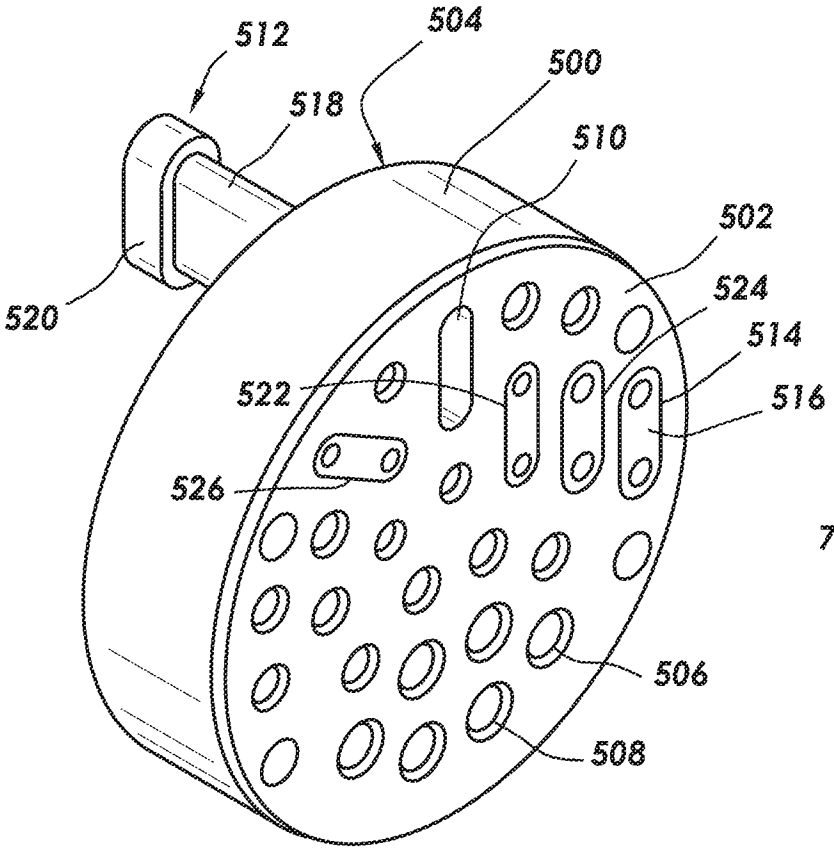
FIG. 5 shows a back perspective view of a seal plate and seal carrier in accordance with at least some embodiments.

FIG. 5 shows a back perspective view of a seal plate and seal carrier in accordance with at least some embodiments. In particular, FIG. 5 shows a seal plate 500 which is representative of either seal plate 308 or 330 of FIG. 3. The example seal plate 500 defines a back side 502, a seal side 504 (not visible), and a plurality of apertures through the seal plate 500. The plurality of apertures includes example through hole assemblies 506 and 508 (only two numbered so as not to unduly complicate the figure). The example through hole assemblies 506 and 508 may be used for individual communicative elements, such as optical fibers or ground conductors. The apertures further include slots, such as slot 510 and slot 514. Each slot extends through the seal plate 500, and each slot may be associated with a twisted pair in order to reduce the un-twisted distance associated with the twisted pair, as discussed more below.

The example seal plate 500, and in particular the slot 510, is associated with a seal carrier 512. The inside surface of the slot 510 defines a cross-sectional shape. In the example of FIG. 5, that cross-sectional shape is an oval. The associated seal carrier 512 has an outside surface that defines a cross-sectional shape that is complementary to the cross-sectional shape of the slot 510. In the example of FIG. 5, the cross-sectional shape is likewise an oval. However, having a slot 510 with an oval shape is merely an example, and any suitable cross-sectional shape of the slot 510 may be used (e.g., circular, elliptical, rectangular, square, egg-shaped), and any suitable cross-sectional shape of the seal carrier 512 may be used, including cases where the shapes do not match, but the seal carrier 512 can nevertheless be inserted into the slot 510. The example seal plate 500 has five slots 510, 514, 522, 524, and 526, and four of those slots have a seal carrier disposed therein (e.g., slot 514 and seal carrier 516); however, any non-zero number of slots may be used.

Still referring to FIG. 5, the example seal carrier 512 defines an insert portion 518 and a stop 520. The insert portion 518 defines an outside surface that has a complementary shape to the visible inside surface of the slot 510. In the example of FIG. 5, the outside surface of the insert portion 518 has a cross-sectional shape that matches and is slightly smaller than the cross sectional shape of a through bore of the slot 510. Though not visible in FIG. 5, the example slot 510 also has a counter bore that forms a stop or shoulder against which the stop 520 of the seal carrier 512 abuts when the seal carrier 512 is inserted into the slot 510.

Figure 6:
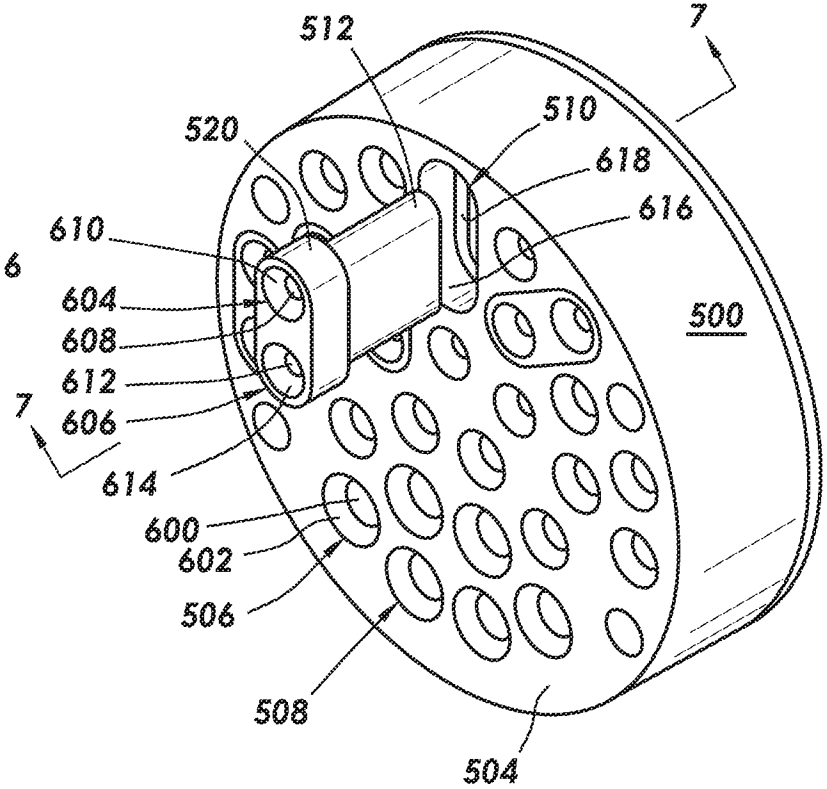
FIG. 6 shows a front perspective view of a seal plate and seal carrier in accordance with at least some embodiments.

FIG. 6 shows a front perspective view of the seal plate 400 and seal carrier 512. In particular, FIG. 6 shows the example seal carrier 512 and the seal side 504 of the example seal plate 500. Each through hole assembly comprises a through bore and a counter bore. Referring to through hole assembly 506 as representative, each through hole assembly comprises a through bore 600 as well as a counter bore 602. In example cases, an elastomeric seal (not shown in FIG. 6) is placed within the counter bore 602 to form the respective assemblies.

The example seal carrier 512 defines a through hole assembly 604 and a through hole assembly 606. The example through hole assembly 604 defines a through bore 608 and a counter bore 610. Similarly, the example through hole assembly 606 defines a through bore 612 and a counter bore 614. In example cases, an elastomeric seal (not shown in FIG. 6) is placed within the counter bore 610, and an elastomeric seal is placed within the counter bore 614, to form the assembly.

Also visible in the view of FIG. 6 is a counter bore 616 associated with the slot 510. The counter bore 616 creates an internal shoulder 618 within the slot 510. When the seal carrier 512 is inserted within the slot 510, the stop 520 (in the example form a ridge that circumscribes the seal carrier 512) abuts the shoulder 618 within the slot 510. The seal carrier 512 can be constructed of any suitable material. In one example embodiment the seal carrier is made a non-conductive material so that the terminal ends of the conductors of the twisted pair can be stripped of insulation, if desired.

Figure 7:
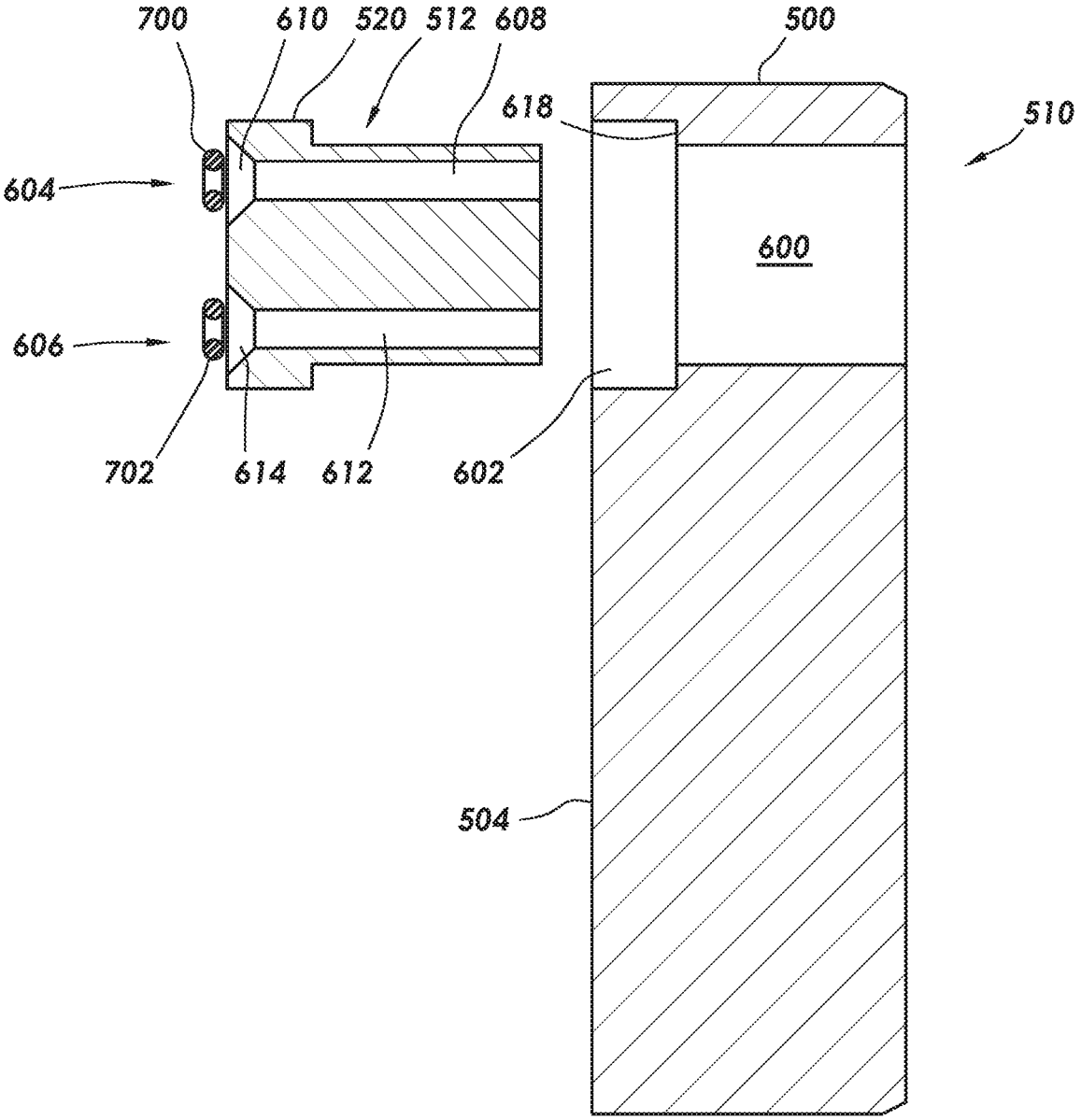
FIG. 7 shows a cross sectional view of the seal plate and seal carrier taken substantially along line 7-7 of FIG. 6, and in accordance with at least some embodiments.

FIG. 7 shows a cross sectional view of the seal plate and seal carrier taken substantially along line 7-7 of FIG. 6, and in accordance with at least some embodiments. In particular, visible in FIG. 7 is a cross sectional view of the example seal plate 500, and a cross sectional view of the example seal carrier 512. The seal plate 500 defines the slot 510. As discussed above, the slot 510 comprises a through bore 600, with the counter bore 602 extending inward from the seal side 504 of the seal plate 500. The intersection of the counter bore 602 and the through bore 600 defines the shoulder 618. The example shoulder comprises a wall that that is parallel to the seal side 504 of the seal plate. However, shoulder 618 may take any suitable shape that mates with the stop 520 of the seal carrier 512 and holds the seal carrier 512 in place relatively to the seal side 504 of the seal plate 500.

The example seal carrier 512 includes the through hole assembly 604 and the through hole assembly 606. The example through hole assembly 604 includes the through bore 608 and counter bore 610 extending inward from the seal side of the seal carrier 512. FIG. 7 also shows an example elastomeric seal 700 (e.g., an O-ring) associated with the through hole assembly 604. In practice, the elastomeric seal 700 resides partially within the counter bore 610, but in the view of FIG. 7 the elastomeric seal 700 is show in exploded view for clarity. Similarly, the example through hole assembly 606 includes the through bore 612 and counter bore 614 extending inward from the seal side of the seal carrier 512. FIG. 7 also shows an example elastomeric seal 702 (e.g., an O-ring) associated with the through hole assembly 606. As before, in practice the elastomeric seal 702 resides partially within the counter bore 614, but in the view of FIG. 7 the elastomeric seal 702 is show in exploded view for clarity. In yet still other cases, the through bore 604 and the through bore 606 may be close enough together that their respective counter bores overlap, and in such cases a single seal assembly such a seal assembly forming a figure "8" may be used.

In accordance with example embodiments, each twisted pair is associated with its own seal carrier (e.g., seal carrier 512). The use of a seal carrier enables re-twisting of the twisted pair after the electrical terminals have been connected and the excess length of the conductors pulled back through the seal carrier. After re-twisting the twisted pair, the seal carrier is inserted into the seal plate 500. The specification now turns to an example step-by-step method of assembly of a water resistant connection in accordance with example embodiments.

Figure 8A:
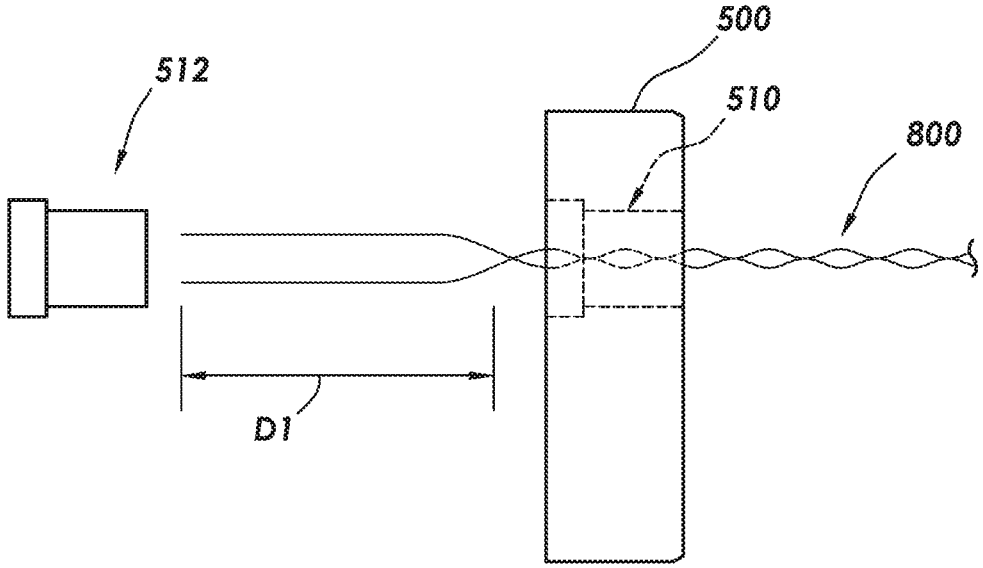
FIGS. 8A-8E show side elevation views of example steps of assembly of a water resistant connection, in accordance with at least some embodiments.

FIG. 8A shows a side elevation view of an example seal plate 500, the seal carrier 512, and a twisted pair 800. Also shown in phantom lines is a cross-sectional view of the slot 510. The example method comprises passing an end of the twisted pair 800 through slot 510 of the seal plate 500. After passing the twisted pair 800 through the slot 510, or before, the example method comprises untwisting the twisted pair 800 for a first distance D1 along the twisted pair 800. The distance D1 is any suitable distance selected by the technician to enable the later steps of attaching terminals to the ends thereof.

Figure 8B:
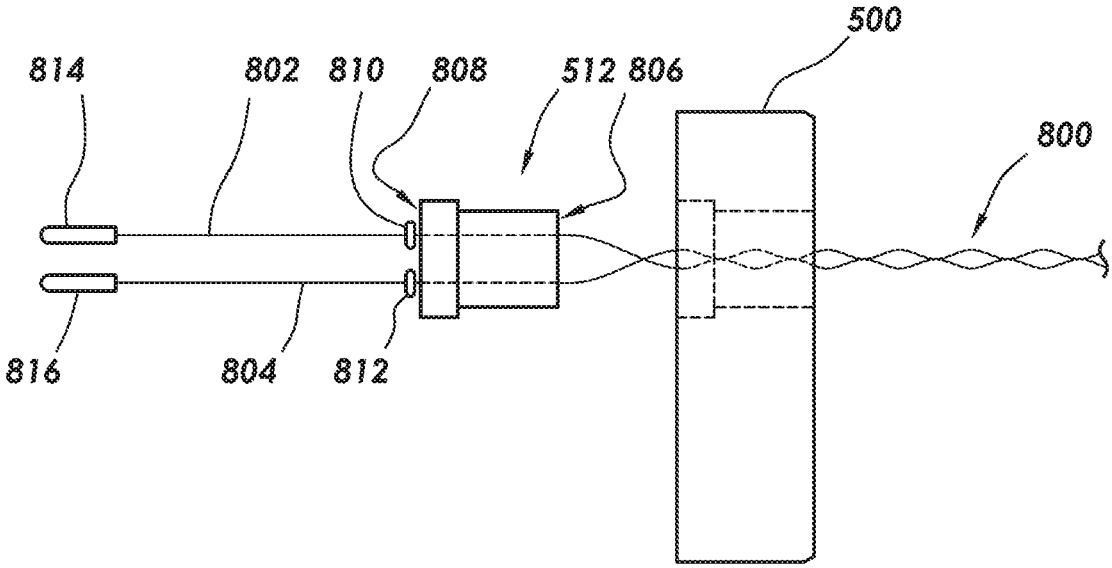

FIG. 8B shows a side elevation view of further example steps. In particular, the example method comprises inserting a conductor 802 of the twisted pair 800 through a first through hole assembly of the seal carrier 512. The example method also comprises inserting another conductor 804 of the twisted pair 800 through a second through hole assembly of the seal carrier 512. In the example shown in FIG. 8B, the insertion of the first conductor 802 and second conductor 804 is in a direction from a second side 806 to a seal side 808 of the seal carrier. In some cases, the act of inserting the conductors 802 and 804 through seal carrier 512 may also thread the conductors through respective seals 810 and 812. However, in other cases the seals may be placed over the respect conductors after the conductors are inserted through the seal carrier 512. In order to provide sufficient working distance, the seal carrier 512 may be slid along the untwisted portion D1 toward the seal plate 500.

FIG. 8B also shows electrical terminals 814 and 816. The electrical terminals 814 and 816 may be plug-type terminals or socket-type terminals, depending on the nature of the overall connector within which the seal plate 500 is used. The electrical terminal 814 is mechanically and electrically coupled to the conductor 802. The electrical terminal 816 is mechanically and electrically coupled to the conductor 804. The electrical terminals 814 and 816 are coupled to the respective conductors 802 and 804 in any suitable form. In some cases the electrical insulation of each conductor is stripped back, and the electrical terminals are crimped to the bare conductors. In other cases, the electrical insulation of each conductor is stripped back, and the electrical terminals are soldered to the bare conductors. In yet still other cases, the electrical insulation remains in place, and each electrical terminal is crimped in such a way as to pierce the electrical insulation to make electrical contact with the underlying conductor.

Figure 8C:
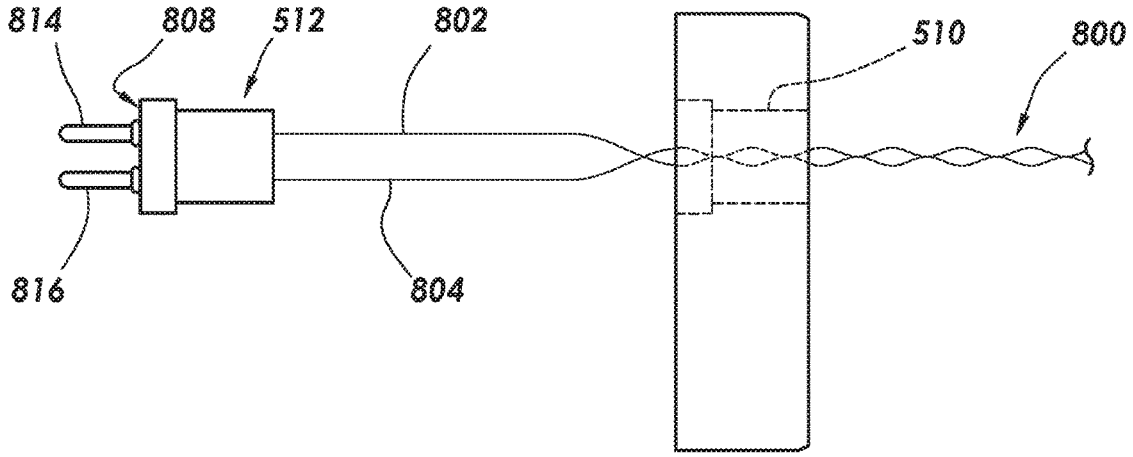

FIG. 8C shows a side elevation view of further example steps. In particular, FIG. 8C shows that, after the electrical terminals 814 and 816 are coupled to the respective conductors 802 and 804, the seal carrier 512 may be slid along the un-twisted portion of the twisted pair 800 such that the electrical terminals 814 and 816 are close to or are engaged with the seal carrier 512 on the seal side 808. Stated oppositely, FIG. 8C shows that, after coupling the electrical terminals 814 and 816, the conductor 802 and the conductor 804 can be pulled, in a direction opposite the earlier insertion, through the seal carrier 512 such that the excess untwisted portion is pulled through and the electrical terminals 814 and 816 are close to or are engaged with the seal side 808 of the seal carrier 808.

Figure 8D:
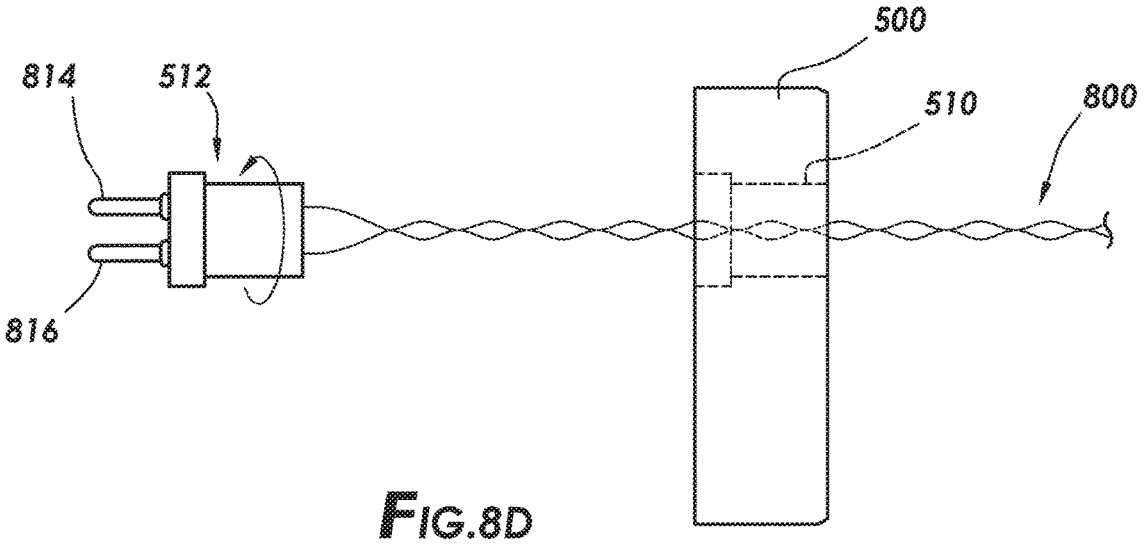

FIG. 8D shows a side elevation view of further example steps. In particular, FIG. 8D shows the example method comprises re-twisting the twisted pair 800 by rotating the seal carrier 512. Because the twisted pair 800 extends through the slot 510, rotating the seal carrier 512 thus re-twists the untwisted portion of the twisted pair 800 along length D1. After re-twisting of the twisted pair 800, the seal carrier 512 may be inserted into the slot 510 of the seal plate 500.

Figure 8E:
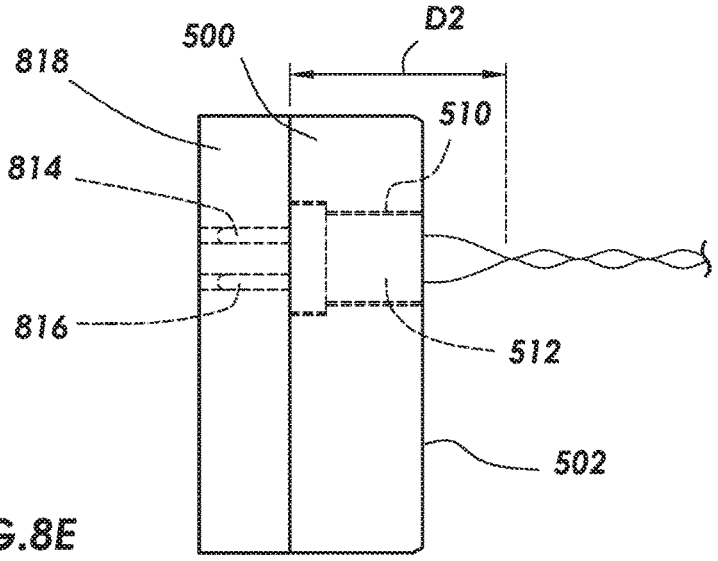

FIG. 8E shows a side elevation view of further example steps. In particular, FIG. 8E shows the seal carrier 512 inserted within the slot 510 of the seal plate 500. FIG. 8E further shows inserting the electrical terminals 814 and 816 into respective apertures of an insert body 818, and abutting the seal plate 500 and seal carrier 512 against the insert body 818. The seal plate 500 may be held in the abutting relationship with the insert body 818 by any suitable system, such as fasteners (not specifically shown) that extend through apertures of the seal plate 500 and into internally threaded apertures of the insert body 818. Insert body 818 is representative of any insert body previously discussed, such as plug-type insert body 306 (FIG. 3) or socket-type insert body 326 (also FIG. 3). The example insert body 818 is shown as a plug-type insert body, where the electrical terminals 814 and 816 reside within the insert body 818 and are exposed through apertures (not specifically shown) in the insert body. However, the example step of inserting the electrical terminals 814 and 816 through respective apertures may also comprise inserting the electrical terminals 814 and 816 into respective apertures of a plug-type insert body such that the electrical terminals 814 and 816 extend through the insert body, such as the insert body 306 and electrical terminals 304 of FIG. 3. Thereafter, the plug assembly comprising the combined seal plate 500, seal carrier 512, and insert body 818 may be placed in a connector housing, such as a housing portion 356 of the socket-type streamer connector 350, or the housing portion 362 of the plug-type streamer connector 352.

As can be seen in the figures, use of the seal carrier 512 and seal plate 500 enables re-twisting of the twisted pair 800. It follows that the untwisted length of the example twisted pair 800 within overall connector is less than the related-art connectors. Still referring to FIG. 8E, in example embodiments, the untwisted length of the example twisted pair is limited to the thickness of the seal plate and the distance from the back side 502 to the first twist of the twisted pair. The combined length of the thickness of the seal plate and the distance from the back side 502 to the first twist of the twisted pair 800 is shown in FIG. 8E as distance D2. In some cases, the distance D2 is less than three centimeters, and in a particular case, the distance D2 is one centimeter or less. Considering again that an equivalent untwisted length may reside only within the mating connector, the total untwisted length may less than 6 centimeters, and in a particular case two centimeters or less.

The above discussion is meant to be illustrative of the principles and various embodiments of the present invention. Numerous variations and modifications will become apparent to those skilled in the art once the above disclosure is fully appreciated. For example, while the insert bodies discussed have been either plug-type insert bodies or socket-type insert bodies, the insert bodies need not be limited to one type or the other. It is intended that the following claims be interpreted to embrace all such variations and modifications.

What is claimed is:

1. Electrical connector apparatus, comprising:

a first seal carrier having first and second through bores therein configured to receive first and second electrical conductors, respectively;

a second seal carrier distinct from the first seal carrier, the second seal carrier having third and fourth through bores therein configured to receive third and fourth electrical conductors, respectively;

a seal plate having a first slot defined through a face thereof, the first slot configured to receive the first seal carrier;

the seal plate having a second slot defined through the face thereof, the second slot distinct from the first slot, the second slot configured to receive the second seal carrier; and an insert body configured to be engaged with the face of the seal plate and to retain the first and second seal carriers within the seal plate.

2. The apparatus of claim 1 further comprising an elastomeric seal configured to fit between the first seal carrier and the insert body and to form a water-resistant barrier around at least one of the first and second through bores.

3. The apparatus of claim 1:

further comprising first and second conductive terminals configured to be fastened to the first and second electrical conductors, respectively; and wherein the insert body has a fifth and sixth through bores therein configured to receive the first and second conductive terminals, respectively.

4. The apparatus of claim 3 wherein at least one of the conductive terminals is a female terminal configured to be housed at least partially with the fifth or sixth through bores.

5. The apparatus of claim 3 wherein at least one of the conductive terminals is a male terminal configured to extend at least partially outside of the fifth or sixth through bores to facilitate engagement with a corresponding female terminal disposed on another connector apparatus.

6. Electrical connector apparatus, comprising:

a seal carrier having first and second through bores therein configured to receive first and second electrical conductors, respectively;

a seal plate having a third through bore in a face thereof, the third through bore configured to receive the seal carrier;

an insert body configured to be engaged with the face of the seal plate and to retain the seal carrier within the seal plate;

first and second conductive terminals configured to be fastened to the first and second electrical conductors, respectively;

the insert body has fourth and fifth through bores therein configured to receive the first and second conductive terminals, respectively; and a marine streamer connector configured to receive the insert body therein such that the first and second conductive terminals are exposed to engage with corresponding conductive terminals within another marine streamer connector.

7. Electrical connector apparatus, comprising:

a seal plate having a first and second slots through a face thereof;

a first seal carrier disposed within the first slot and having first and second through bores therein;

a second seal carrier disposed within the second slot and having third and fourth through bores therein;

an insert body engaging the face of the seal plate so as to retain the first and second seal carriers within the seal plate;

first and second electrical conductors extending through the first and second seal carrier through bores, respectively, from a cable side to a mating side of the first seal carrier;

third and fourth electrical conductors extending through the third and fourth seal carrier through bores, respectively, from a cable side to a mating side of the second seal carrier;

first and second conductive terminals attached to the first and second electrical conductors, respectively, on the mating side of the first seal carrier, and disposed at least partially within the insert body; and third and fourth conductive terminals attached to the third and fourth electrical conductors, respectively, on the mating side of the second seal carrier, and disposed at least partially within the insert body.

8. The apparatus of claim 7, wherein:

the first slot comprises a shoulder; and the first seal carrier comprises a stop that is engaged with the shoulder.

9. The apparatus of claim 7, wherein:

the first seal carrier comprises a counter bore in at least one of the first and second seal carrier through bores; and an elastomeric seal is disposed at least partially within the counter bore.

10. The apparatus of claim 7 wherein the first and second electrical conductors comprise one end of a twisted pair cable that is twisted up to a point where the conductors enter the cable side of the first seal carrier.

11. The apparatus of claim 10 wherein a distance between the first and second conductive terminals and the point is less than about 3 cm.

12. The apparatus of claim 10 wherein a distance between the first and second conductive terminals and the point is less than about 1 cm.

13. Electrical connector apparatus, comprising:

a seal plate having a seal plate through bore in a face thereof;

a seal carrier disposed within the seal plate through bore and having first and second seal carrier through bores therein;

an insert body engaging the face of the seal plate so as to retain the seal carrier within the seal plate;

first and second electrical conductors extending through the first and second seal carrier through bores, respectively, from a cable side to a mating side of the seal carrier;

first and second conductive terminals attached to the first and second electrical conductors, respectively, on the mating side of the seal carrier, and disposed at least partially within the insert body; and an elastomeric seal disposed between the seal carrier and the seal plate so as to form a water-resistant barrier around at least one of the first and second seal carrier through bores.

14. Electrical connector apparatus, comprising:

a seal plate having a seal plate through bore in a face thereof;

a seal carrier disposed within the seal plate through bore and having first and second seal carrier through bores therein;

an insert body engaging the face of the seal plate so as to retain the seal carrier within the seal plate;

first and second electrical conductors extending through the first and second seal carrier through bores, respectively, from a cable side to a mating side of the seal carrier; and first and second conductive terminals attached to the first and second electrical conductors, respectively, on the mating side of the seal carrier, and disposed at least partially within the insert body;

a marine streamer connector; and wherein the insert body is disposed within the marine streamer connector such that the first and second conductive terminals are exposed for engagement with corresponding conductive terminals in another marine streamer connector.

15. A method of manufacturing electrical connector apparatus, comprising:

untwisting an end of a twisted pair conductor cable along a length D;

passing the end of the twisted pair conductor cable through a through bore in a seal plate;

passing ends of first and second conductors of the twisted pair conductor cable through first and second through bores, respectively, in a seal carrier;

fastening conductive terminals to the ends of the first and second conductors;

sliding the twisted pair conductor cable or the seal carrier relative to one another such that the conductive terminals are disposed proximate to or abut a mating side of the seal carrier;

rotating the seal carrier so as to re-twist the twisted pair conductor cable along at least a portion of length D; and inserting the seal carrier into the through bore in the seal plate.

16. The method of claim 15 wherein the step of rotating the seal carrier comprises rotating it until the twisted pair conductor cable is re-twisted up to a point at which the first and second conductors enter the seal carrier.

17. The method of claim 15, further comprising fastening an insert body to the seal plate so as to retain the seal carrier within the seal plate and such that the conductive terminals are disposed at least partially within through bores in the insert body.

18. The method of claim 17, further comprising placing an elastomeric seal between the seal carrier and the insert body so as to form a water-resistant barrier around at least one of the first and second through bores in the seal carrier.

19. The method of claim 18, wherein placing the elastomeric seal comprises threading an opening in the elastomeric seal over the end of one of the first and second conductors.

20. The method of claim 19, wherein placing the elastomeric seal further comprises disposing the elastomeric seal at least partially within a counter bore of one of the first and second through bores of the seal carrier.

* * * * *